United States Patent [19]

Nelson

[11] Patent Number: 4,704,856

[45] Date of Patent: Nov. 10, 1987

[54] FALSE TWISTED DIFFERENTIAL TENSION YARN

[75] Inventor: Thomas L. Nelson, Georgetown, Del.

[73] Assignee: E. I. Du Pont de Nemours and Company, Wilmington, Del.

[21] Appl. No.: 857,350

[22] Filed: Apr. 30, 1986

Related U.S. Application Data

[63] Continuation-in-part of Ser. No. 817,385, Jan. 9, 1986.

[51] Int. Cl.[4] ..... D02G 3/38; D02G 3/04

[52] U.S. Cl. ..... 57/228; 57/247

[58] Field of Search ..... 57/225, 226, 227, 228, 57/246, 247

[56] References Cited

U.S. PATENT DOCUMENTS

| | | | |
|---|---|---|---|
| 3,427,647 | 2/1969 | Field | 57/144 |
| 3,438,193 | 4/1969 | Kosaka et al. | 57/228 |
| 3,967,441 | 7/1976 | Yasuzuka et al. | 57/140 J |
| 3,968,638 | 7/1976 | Norton et al. | 57/140 R |
| 3,971,200 | 7/1976 | Richter | 57/34 |
| 3,991,244 | 11/1976 | Debbas | 428/113 |
| 4,016,329 | 4/1977 | Matsuyama et al. | 428/375 |
| 4,148,179 | 4/1979 | Becker et al. | 57/350 |
| 4,222,223 | 9/1980 | Nelson | 57/246 |
| 4,280,261 | 7/1981 | Nelson | 28/271 |
| 4,307,565 | 12/1981 | Sasaki et al. | 57/205 |
| 4,343,146 | 8/1982 | Nelson | 57/208 |
| 4,355,592 | 10/1982 | Tajiri et al. | 112/410 |
| 4,452,160 | 6/1984 | Tajiri et al. | 112/410 |

*Primary Examiner*—Donald Watkins

[57] ABSTRACT

A continuous multifilament crimped polyamide or polypropylene yarn suitable for use in loop pile carpeting and the process for making the yarn including feeding the yarn at different tensions and then treating the yarn with saturated steam is disclosed.

10 Claims, 17 Drawing Figures

R R R R R R

R R R R R R

FALSE TWISTED DIFFERENTIAL TENSION YARN

CROSS-REFERENCE TO RELATED APPLICATION

This application is a continuation-in-part of copending application Ser. No. 817,385 filed Jan. 9, 1986.

DESCRIPTION

1. Technical Field

This invention relates generally to improved false twisted yarns, more particularly it relates to a polyamide and polypropylene yarns useful in making loop pile carpet with minimal observable directionality and the process for making such yarns.

2. Background

Loop pile carpets are most commonly made on a tufting machine in which multiple needles, each carrying a pile yarn, push the yarns through a backing fabric where they are held in place to form loops as the needles are withdrawn. The process then repeats, forming straight lines of loops along the length of the advancing backing fabric. When conventional pile yarns having no twist or balanced ply twist are employed, the carpet will appear different when viewed along the length of the fabric and transversely because of the different loop geometries in the two directions. This phenomenon is known as directionality. Furthermore, the tufts are seen to be aligned in distinct rows when viewed from either direction.

The directionality usually requires that all of the carpet in a given location must be pieced together so that all run in the same direction; otherwise, a joint between two portions of different direction will be seen as a nonuniformity.

The distinct rows can be minimized to a certain degree by moving the needles back and forth laterally as the backing advances ("step-over tufting"), but this requires a more expensive tufting machine and does not eliminate the problem.

Many popular carpet styles require ply twisting two or more individual crimped yarns either to produce a larger yarn than can normally be obtained with a single yarn or to give the integrity and appearance of a twisted product. Two or more differentially-colored or differentially-dyeable yarns are frequently plied to give multi-colored effects. The process of ply twisting is expensive because centrifugal force limits the speed at which heavy yarn supply packages can be rotated around each other, resulting in a relatively low linear yarn speed of about 40 to 70 yards (37 to 64 meters) per minute.

It is known that when two or more yarns are ply twisted under unequal tensions, the yarn under highest tension migrates to the center of the assemblage and those under lower tension appear at the surface, spiralling around the higher tension "core" yarn and creating a "barber-pole" appearance when the yarns are of different coloration or luster. Such "coring" is generally considered undesirable.

Field U.S. Pat. No. 3,427,647 discloses a somewhat similar process for wrapping yarns around a false-twisted core wherein the wrapping yarns migrate forward and backward with respect to the core yarn, giving zones of over-wrapping. Such zones are generally undesirable in yarns for carpet use, since the wrapping yarns are usually of large denier and over wrapped zones may be excessively large in diameter, causing feeding problems in tufting machine tubes and needles.

SUMMARY OF THE INVENTION

A continuous multifilament crimped polyamide or polypropylene yarn suitable for use in loop pile carpeting comprising at least one continuous multifilament crimped core yarn and at least one continuous multifilament crimped wrap yarn characterized by the filaments of the wrap yarn being from 1 to 14% longer than the filaments of the core yarn and forming randomly reversing coils about the core yarn has now been discovered. The yarn is further characterized by some of the filaments within the wrap yarns being lightly bonded to each other and the wrap yarn having cylinder bulk of about 70–85% of the core yarn. A cut length of yarn has a twist after boil-off of at least one twist per inch (39 twists per meter) and preferably at least two twists per inch (79 twists per meter).

The product of the invention comprises one or more bulked continuous filament core yarns aligned on the axis of the combined yarn surrounded at least partially by one or more bulked continuous filament wrapping yarns which progress around the periphery of the shorter core yarn or yarns in random reversing coils as shown in FIG. 5A of about 180° C. when the yarn is observed under tension, the wrapping yarns being lightly bonded and tightly adhered to the core yarns, the combined yarn having at least one turn per inch (39 turns per meter), preferably for polyamide at least 2 turns per inch (79 turns per meter) unidirectional twist when a cut length has been boiled. The cylinder bulk of a wrapping yarn is preferably about 70 to 85% of the bulk of a core yarn for polyamide and preferably about 70–90% for polypropylene. The Bulk Crimp Elongation of the yarn is about 20–40%. The yarn comprises less than 10% uncrimped filaments and the uncrimped filaments may be antistatic.

The yarn bundle may be substantially free of true yarn twist. This does not excluded a small amount of twist which may occur incidentally in the handling of the yarn bundle, such as by overend take off of the yarn bundle in a conventional manner from a stationary package, as from a creel. A yarn bundle having no more than about one turn of true twist per 3 cm is considered to be substantially twist free.

The process for making this continuous multifilament crimped yarn suitable for use in loop pile carpeting comprises the steps of: (a) feeding at least two multifilament crimped polyamide or polypropylene yarns at different tensions through a heating zone in a false-twisted state; (b) heating the false-twisted yarns with saturated steam; and (c) false-twisting the yarns.

At least one yarn of crimped multifilaments may be fed at a positive tension of about 0.02 to 0.25 grams per denier and at least one other yarn of crimped multifilaments may be fed at a positive tension of about 0.012 to 0.16 gpd lower than the first, the yarns being fed together through a pressurized saturated steam heating zone where at least the surface filaments reach a temperature high enough to set them into a false wrapped configuration; and where the yarns are false twisted, the yarn or yarns of lower tension are wrapped about the yarn of higher tension in random reversing coils and radially compressed while heated, then passed through a false twisting device and wound on a package.

The tension on the first yarn is most preferably 0.04 to 0.16 gpd and the tension on the second yarn is most preferably 0.032 to 0.10 gpd lower than the first.

The heating zone preferably comprises a chamber having close-fitting inlet and outlet passages where saturated steam impinges transversely on the yarns as described in copending application U.S. Ser. No. 754,703 filed 7/15/85. However, the present technology differs from that disclosed in the previous application in that the higher tension yarn of the present application is compacted by twist while in the heating chamber so that its filaments are not free to separate and be heated individually or to entangle substantially. Therefore, only the filaments of the lower tension yarns and surface filaments of the higher tension yarn are exposed to the full effect of the saturated steam. The heating and plasticizing effect of the steam penetrates far enough into the higher tension yarn to set in latent torque. The lower tension yarns are set into their wrapped configuration by the effects of the steam and the radial compression. There may be a limited degree of entanglement between filaments of the lower tension and higher tension yarns. Excessively high steam temperatures or exposure times can result in fusing the entire yarn.

The false twisting device is preferably a fluid torque jet of the type disclosed in U.S. Pat. No. 3,079,745, using compressed air at about ambient temperature to twist and cool the yarns. The twisting device should be operated at conditions sufficient to produce twist in any 1 inch (2.54 cm) section of yarn of at least 1 turn, preferably 2 turns, when 6-inch (15.24 cm) cut lengths of yarn are suspended in boiling water.

When yarns made by the process of the invention are made into loop pile carpets and heated as in latexing, scouring or dyeing, the false twist which was set into the combined yarns while they were in the heating zone causes the tufts to twist out of their usual alignment to varying degrees. At the same time, the yarn under higher tension retracts toward the backing fabric to a higher degree than others at lower tension.

The twisting of the tufts, particularly in densely constructed carpets, is facilitated by agitation during the part of the heating process in which twist develops, as by jetting hot dye liquor on the carpet face or liquid agitation in a dye bath. The retraction is non-uniform from tuft to tuft, resulting in pleasingly irregular carpet surface. Both the twisting and the retraction move tufts out of alignment in all directions, thus minimizing directionality and visible rows to varying degrees depending on the nature of the yarn and the carpet construction.

In fairly open carpet constructions where tufts are less restrained by neighboring tufts, the loops may twist and retract to greater degrees and may hide the backing much more effectively than conventional yarns.

In addition to the twisting and retraction behavior described above, the lower tension yarn or yarns wrap around the higher tension in reversing coils which are random in direction and in frequency of reversals. This gives a further appearance of randomness, particularly when the yarns are of different color or dyeability.

As a result of the above behavior, optimum carpets made from yarns of the invention may be placed together with the machine direction of one portion adjoining the transverse direction of another without a noticeable change of appearance at the junction.

As a result of the twist setting which the combined yarn receives in the heating zone and the compression of any surface filament loops into the bundle which results from passage through the confined entrance and exit passages of the preferred steam heating apparatus as well as from impingement of steam on the yarns which may contribute some degree of filament entanglement, the yarn has sufficient cohesion to pass through a tufting machine creel and needles without trouble in spite of lacking true twist or large degrees of entanglement. Because the yarn is twisted when the saturated steam impinges on it, the filaments at the center of the core yarn receive less treatment than the filaments at the surface of the core yarn. The filaments of the wrapping yarn are more thoroughly treated with saturated steam than the filaments of the core yarn. The difference in steam treatment received contributes substantially to the difference in properties and character of the wrapping and the core yarns. The as-wound yarn package has a crinkled textured appearance quite unlike the smooth surface of a conventional bulked continuous filament yarn.

One function of the differential tension is to facilitate twisting. When yarns are twisted under equal tension, the outermost filaments travel a greater distance than the innermost and are therefore tensioned to a higher degree. The force needed to tension these filaments opposes the twisting applied force and inhibits the degree of twist achieved. When some yarn or yarns are under lower tension, they are able to wrap around a higher-tension end more readily. Therefore, a given torque in the twisting device results in a much higher degree of twist, particularly when the twisting device is a fluid torque jet.

To illustrate the above effect, three bulked continuous filament polyamide yarns, one of which is black for visibility, are fed through a process as illustated in FIG. 1 below. All conditions are the same except that the tension on yarn 10 is higher than the other two yarns designated as yarn 11. Photographs are taken of the twist in the yarns between guide 16 and heating zone 18 by high-speed flash.

TABLE I

| | A | B | C |
|---|---|---|---|
| Tension yarn 10, gm | 15.0 | 30.0 | 100.0 |
| gpd | 0.0 | 0.008 | 0.026 |
| yarn 11, gms | 15. | 15.0 | 15.0 |
| gpd | 0. | 0.004 | 0.004 |
| Average twist, | | | |
| turns per inch | 0 | 2.0 | 6.0 |
| turns per meter | 35 | 79 | 236 |

It can be seen that providing differential tension increases the degree of twist over six times within the ranges of tensions shown above. Different levels of tension in the lower and higher tension ends will give different degrees of twist, which may be determined by experimentation.

The degree of differential tension should be sufficient to produce the benefits described above yet should not be so large that a higher tension yarn is stretched enough to remove its crimp or a lower tension end is so slack that it projects from the surface of the combined yarn and can snag and strip back while feeding through tufting machine guides or needles. Acceptable degrees of differential tension will vary depending on the nature of the yarns employed. Differential tensions are preferably about 0.008 to 0.24 grams per denier, most preferably 0.028 to 0.155 grams per denier.

DETAILED DESCRIPTION OF THE DRAWINGS

Figures 1, 3:
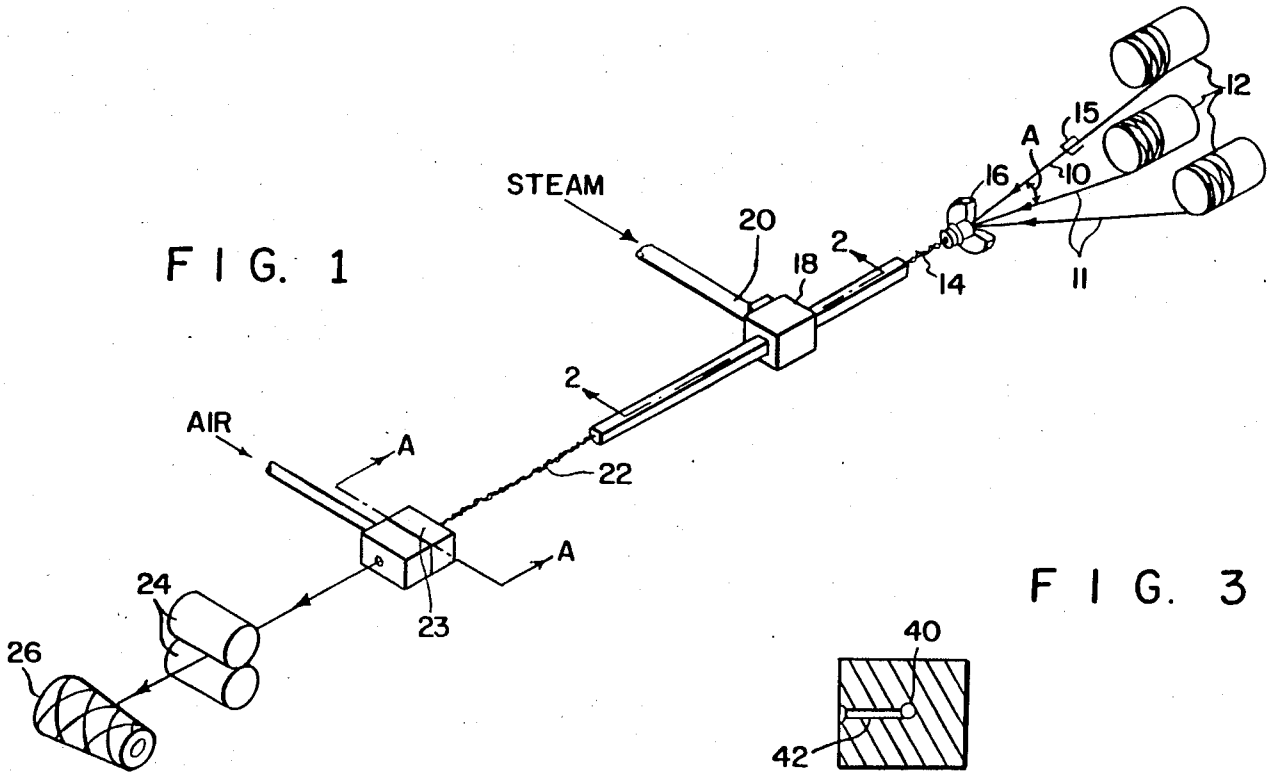
FIG. 1 is a schematic diagram of a preferred process of the invention.
FIG. 3 is a schematic diagram of a torque jet apparatus.

Referring to FIG. 1, one or more crimped continuous filament polyamide yarns 10 & 11 are taken from supply packages 12, combined into a yarn bundle 14 at guide 16 and led through heating zone 18 which is preferably a device in which the yarn is treated by impinging saturated team at elevated pressure on the yarn bundle. Saturated steam is supplied from a source (not shown) and enters the heating device 18 through pipe 20. Treated yarn 22 then passes through forwarding rolls 24 to windup package 26. Tensioning device 15 is placed on one or more of the supply yarns, such as 10, to regulate the desired differential tension. Torque jet 23 supplied with compressed air from a source not shown twists treated yarn 22 within heating device 18 so that it is steam treated while in a false twisted condition. The stored twist returns to zero after torque jet 23.

Figure 2:
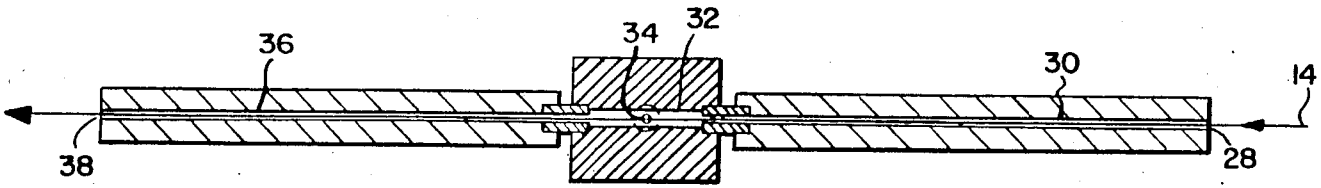
FIG. 2 is a schematic diagram of a preferred heating apparatus.

FIG. 2 shows a longitudinal cross section of the preferred heating device 18 in FIG. 1 taken on a line 2—2 wherein yarn bundle 14 enters inlet 28, an elongated tube having a close-fitting passage 30 through which the yarn bundle passes to chamber 32 where a portion of the saturated steam from chamber 32 travels countercurrent to the direction of yarn movement and begins to heat yarn bundle 14. As the yarn bundle enters chamber 32, saturated steam from orifice 34 impinges on the longitudinal axis of the chamber and the yarn bundle after which the yarn passes out of chamber 32 through close-fitting passage 36 of outlet 38.

FIG. 3 shows a cross section of torque jet 23 of FIG. 1 taken at A—A. Yarn 22 passes through yarn passage 40 where rectangular air orifice 42 impinges compressed air tangentially on yarn 22, twisting it in a counter-clockwise direction.

In the preferred embodiment of the invention shown in FIG. 1, the lower tension yarn or yarns 11 join the higher tension yarn 10 at a guide 16 which may stop twist from traveling back toward tensioner 15. Such guides may have a V-shaped groove to grip the yarn or may be a pair of rotating rollers gripping the yarn between them. This arrangement will insure that a single lower tension yarn 11 will wrap around the higher tension yarn 10 relatively uniformly along the end. When two or more lower tension yarns 11 are used, all wrap in approximately the same direction at the same time. If twist in yarn 10 is not completely stopped by guide 16, approximately the same uniformity may be procured by introducing yarns 10 and 11 at guide 16 while maintaining an angle hetween the higher tension and lower tension ends of at least about 10° to prevent the low tension ends from wrapping around the high tension end before reaching guide 16.

Figure 4:
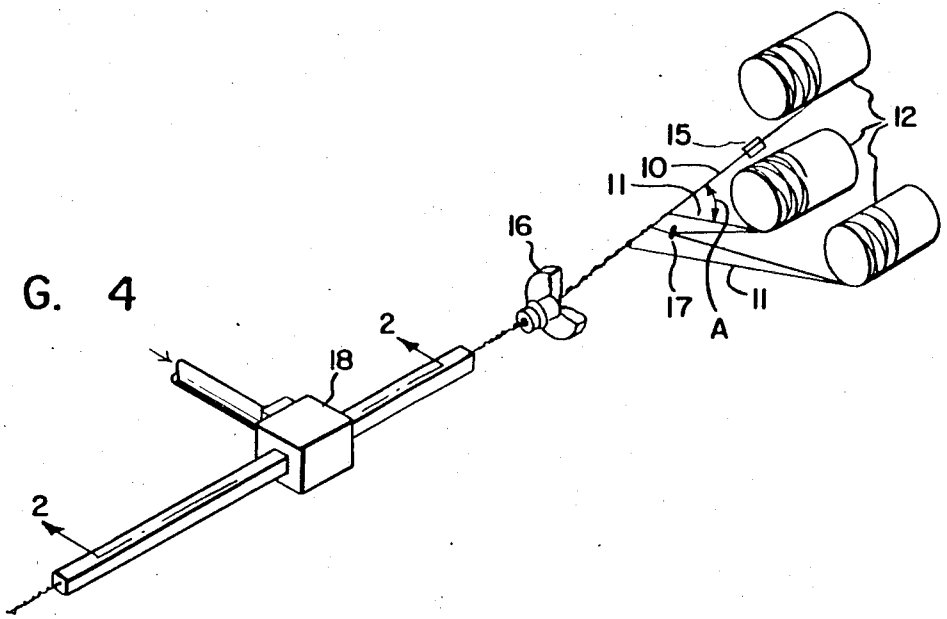
FIG. 4 is a partial diagram of an alternate process of this invention.

In another preferred embodiment shown in FIG. 4, twist in yarn 10 is allowed to travel back to tensioner 15 when guide 16 is a plain bushing or equivalent and yarns 11 wrap around yarn 10 as they approach guide 16. If yarns 11 meet yarn 10 at different locations, as shown in FIG. 4, they will be out of phase with each other and give a further degree of random twist appearance. If they are introduced at the same location as by providing guide 17, they will wrap in the same direction and in phase. When the location at which the low-tension yarn or yarns are introduced is not fixed by a guide, the wrapping pattern will be more random.

Many wrapping patterns may be produced by varying the location at which the yarns meet, the angle A between the high and low tension ends, the absolute values of tensions, and the difference in tensions between ends. Over-wrapping may be prevented by operating the present process at about 200 ypm (183 mpm) or more, employing lower angles between low and high tension ends, and/or by fixing the location where the ends meet as by providing guides.

When the angle between lower tension and higher tension ends is small, the difference in length between the wrapping filaments and the core filaments will also be small; while as the angle approaches 90°, the difference in length will increase.

Figure 5A:
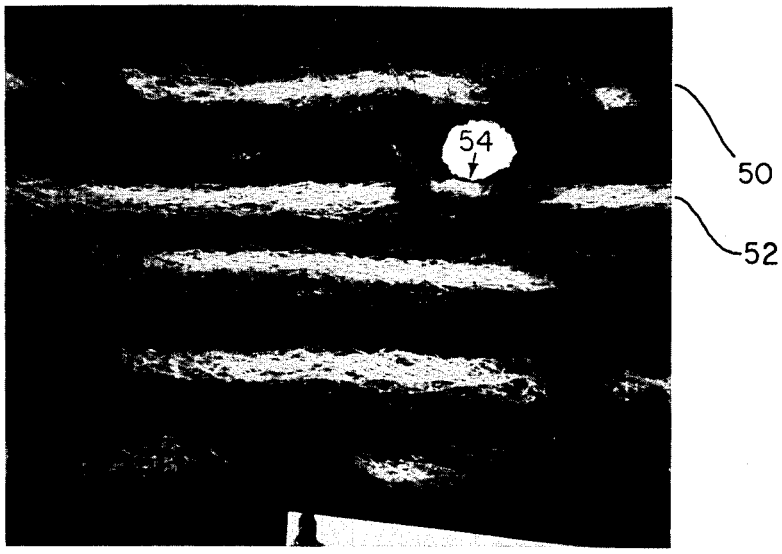
FIGS. 5A and 5B are side views of the yarn of Example 3 of the invention at 3× and 8× magnification.

FIG. 5A, a yarn of the invention made according to Example 3, is shown at a magnification of 3× after relaxed boil-off in skein form when the wrapping and crimp are fully developed, the lower tensioned wrapping yarns being dyed darker than the core to distinguish the wrapping character. The yarn is tensioned. Because the wrapping of two lower tension yarns 50 around higher tension core yarn 52 varies in degree along the yarn length and reverses at 54, the yarns in the carpet do not display the objectionable "barber pole" appearance which occurs in uniformly-twisted yarns.

Figure 5B:
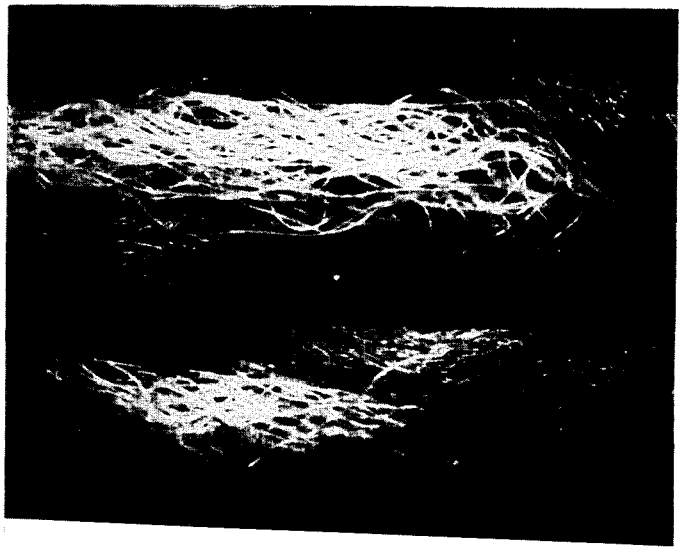

FIG. 5B shows the same yarn as FIG. 5A at a magnification of 8×.

Figure 6A:
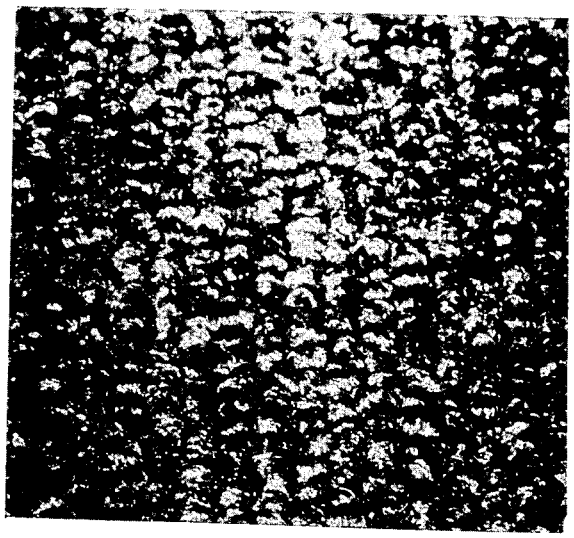
FIG. 6A is a typical loop pile carpet viewed along the length of the backing in the direction of backing travel.
Figure 6B:
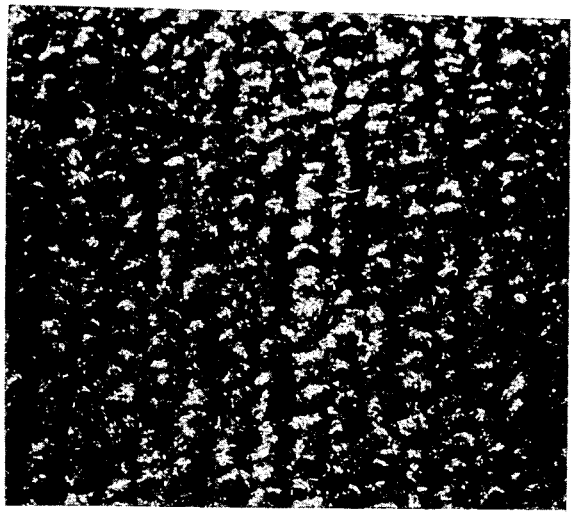
FIG. 6B is the same loop pile carpet viewed transversely to the direction of backing travel.

FIGS. 6A and 6B show two views of a typical loop pile carpet of ⅛ inch (3.18 mm) gauge, ¼ inch (6.36 mm) pile weight, 24 oz. per square yard (814 gms/m$^2$) and 10 stitches per inch (3.94 stitches per cm) in which the tufts are aligned in geometric rows R when viewed in either direction.

Figure 7A:
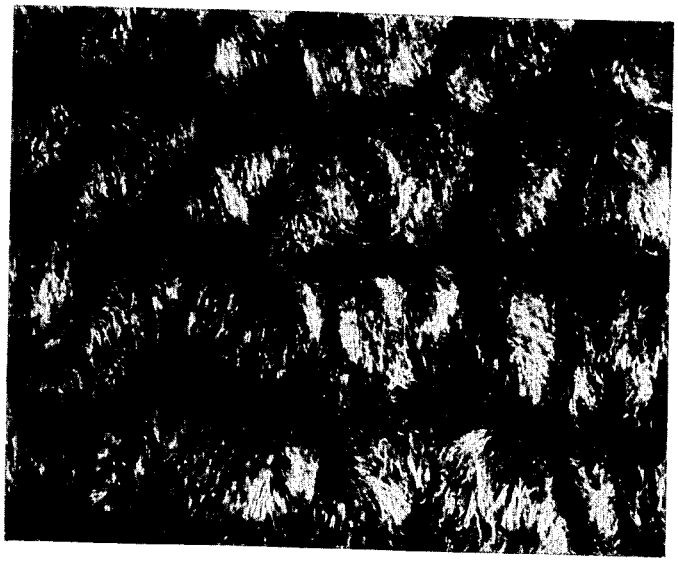
FIG. 7A is a typical loop pile carpet viewed at a higher magnification.

FIG. 7A shows a view similar to FIG. 6A but at a higher magnification of 3× of another typical loop pile carpet made from 4 ends of 5000 denier Du Pont Type 365A polyamide carpet yarn, tufted at 5/16 inch (3.98 mm) gauge, ½ inch (1.27 cm) pile height, 45 oz. per square yard (1526 gms/m$^2$) and 3.5 stitches per inch (1.38 stitches per cm) in which the tufts are aligned in geometric rows R.

Figure 7B:
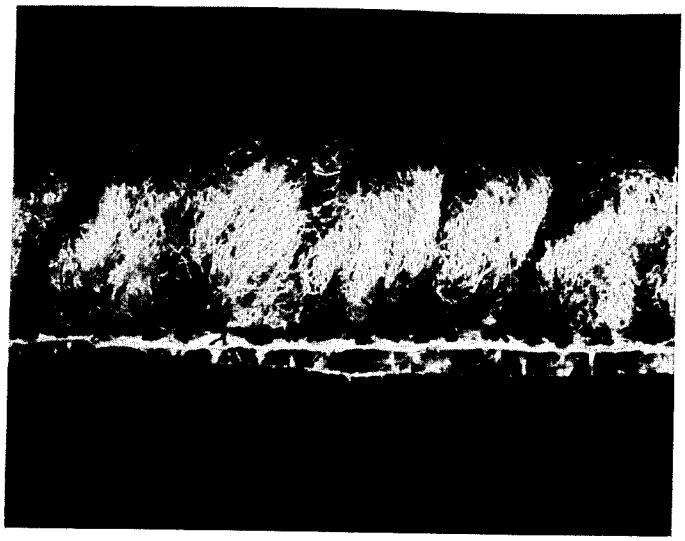
FIG. 7B is a close-up side view of the carpet of FIG. 7A.

FIG. 7B shows a side view of the carpet of FIG. 7A at a magnification of 3×.

Figure 8A:
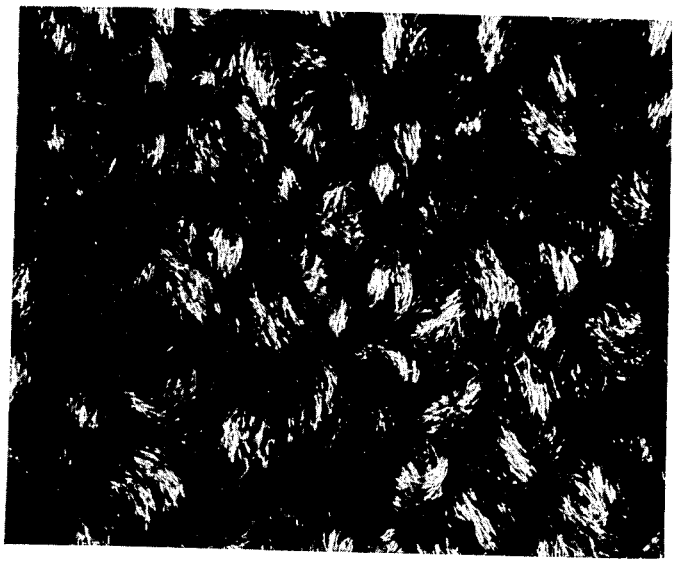
FIG. 8A is a loop pile carpet made from yarn of Example 6.

FIG. 8A shows a view similar to FIG. 6B at a magnification of 3× of a carpet made from the yarn of Example 6 showing a lack of rows.

Figure 8B:
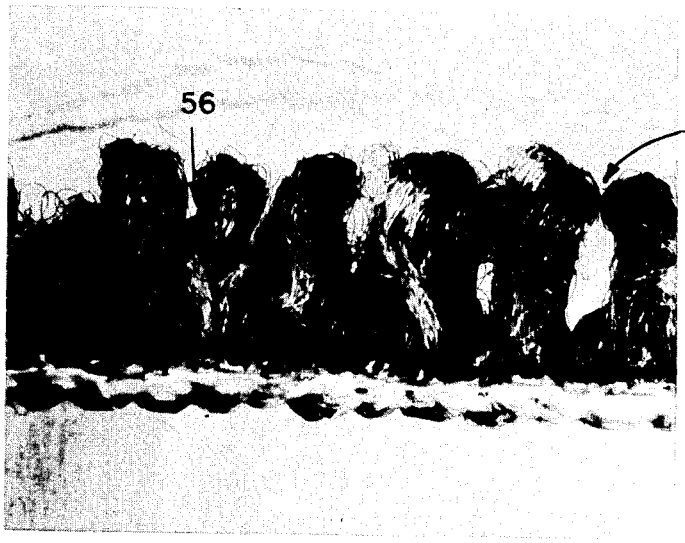
FIG. 8B is a close-up side view of the fabric of FIG. 8A.

FIG. 8B shows, at a maganification of 3×, that the loops are positioned randomly with respect to the viewer because of twisted sections 56 which vary in direction and degree. Some tuft tips are curled as shown at 58. Therefore, the tops of the loops are displaced from a geometric alignment in all directions, substantially eliminating directionality and rowiness.

Figure 9A:
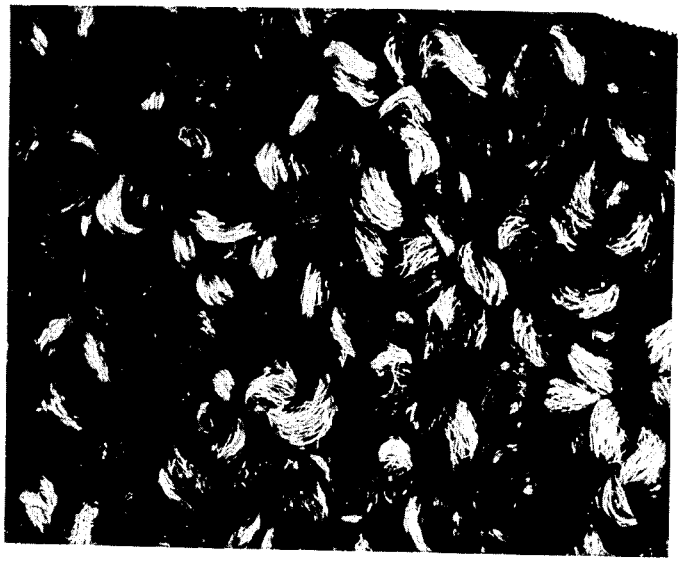
FIGS. 9A and 9B show the same as FIGS. 8A and 8B for Example 7.
Figure 9B:
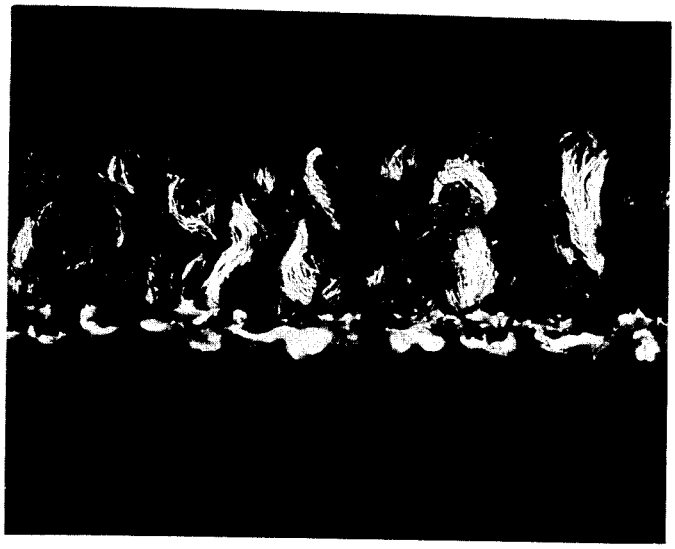

FIGS. 9A and 9B show the same as FIGS. 8A and 8B for Example 7.

Figure 10A:
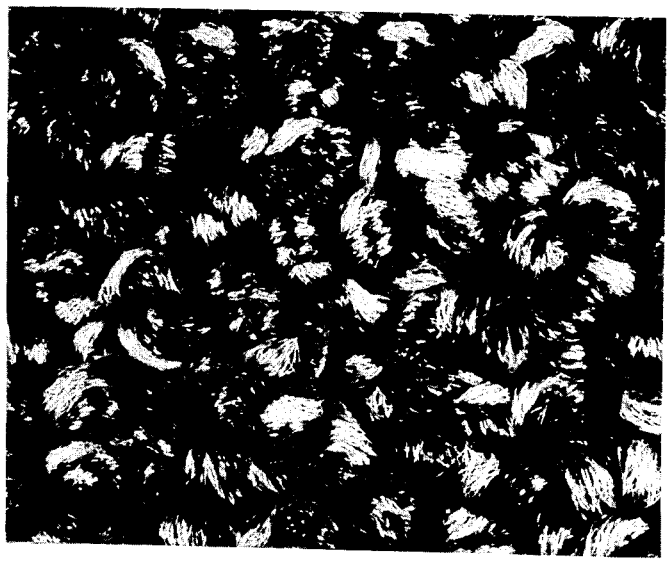
FIGS. 10A and 10B show the same as FIGS. 8A and 8B for Example 9.
Figure 10B:
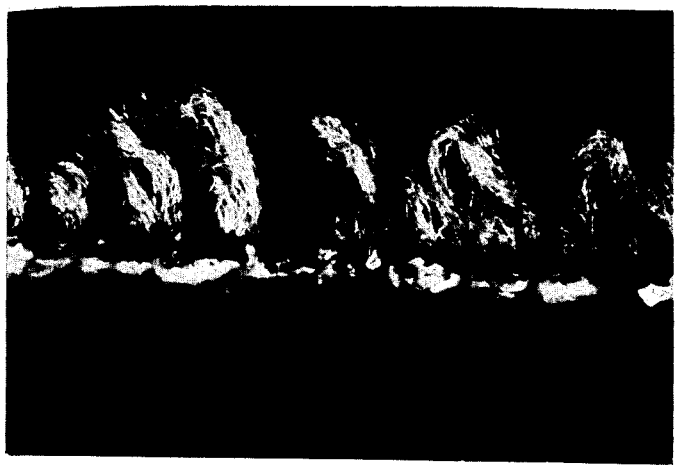

FIGS. 10A and 10B show the same as FIGS. 8A and 8B for Example 9.

TEST METHODS

Filament Length Differential

Each differentially-dyeable type of filament in a sample of the yarn is dyed to a distinctive color or shade using an appropriate conventional cross-dyeing procedure with at least one dye for each type. Alternatively, only the lighter dyeable filaments may be left undyed. In the present examples, the higher tension core yarn is undyed. A 10–12 inch (25.4–30.5 cm) length of the cross-dyed yarn is hung vertically and a simple overhand knot tied tightly near the mid-point of the sample. A 0.025 gram per denier weight (100 gram weight for a 4000 denier yarn) is attached to the free end of the sample. The yarn is carefully cut into two pieces at a point 2 inches (5.08 cm) below the knot. Filament entanglement in the yarn below the knot is carefully combed out using a fine wire brush such as that used to brush or raise the nap on suede leather. A strip of double-adhesive transparent tape which exceeds two inches (5.08 cm) in length in one direction is placed on black matte paper. The combed out filaments are carefully cut free immediately below the knot. Using tweezers, five filaments from each component color are placed in parallel array on the exposed surface of the double adhesive tape. The mounted filaments are then covered by a strip of single-adhesive transparent tape to secure them firmly in place. The length of each filament is measured with a map distance measuring instrument such as one manufactured by Keuffel and Esser No. 620300. The steps are repeated until 50 individual filament lengths for each color have been recorded. The average of the 50 measurements is calculated for each filament type. The averages for the non-light dyeing filaments are also averaged with each other. The percent filament length differential is then calculated by subtracting the combined average length for all the deeper dyed filaments from the average length for the lighter dyed filaments. This difference is then divided by the combined average of all the deeper dyed filaments and multiplied by 100 to obtain the percent differential.

Cylinder Bulk

Specific volume of yarns is determined by cutting boiled-off and conditioned samples into lengths shorter than the inside diameter of a test cylinder, dropping a weighed specimen into the cylinder, and carefully lowering a piston into the cylinder until it comes to rest on the specimen. The piston exerts 3.1 psi (21.4 kPa) pressure on the specimen and has as calibrated stem for reading the volume occupied by the specimen. The reading is taken 100±5 seconds after the piston comes to rest. Specific volume is determined by dividing the volume by the sample weight. The particular pressure employed is considered representative of typical furniture loadings on carpet.

Twist After Boil-Off

Lengths of yarn 6 inches (15.14 cm) long under no load are clamped at one end and are lowered into a boiling dye bath where they are held until no further twist develops. The yarns are preferably differentially colored or dyeable to facilitate twist counting. After drying, the twisted samples are laid alongside a ruler and the number of twists per inch are measured.

EXAMPLES

The control yarn and the yarn for Examples 1–5 were prepared as described below. Three ends of standard Bulked Continuous Filament nylon 66 carpet yarn are fed into a process in accordance with FIG. 1. End 10 is 1225 denier Du Pont Type 495 light acid dyeable BCF yarn and the other two yarns 11 are 1245 denier Type 497A deep acid dyeable yarns having conductive-core filaments to dissipate static electricity. Heating device 18, also shown in FIG. 2, has an inlet 28 with passage 30 of 0.060 inch (1.52 mm) inside diameter and 8 inches (20.3 cm) long, a steam orifice 34 of 0.046 inch (1.17 mm) diameter, a chamber 32 of 0.063 inch (1.51 mm) diameter and 1.0 inch (2.54 cm) long, and an outlet 38 having passage 36 of 0.060 inch (1.52 mm) inside diameter and 12 inches (30.5 cm) long. Torque jet 23 has a yarn passage 40 of 0.093 inch (2.36 mm) inside diameter and rectangular air orifice 42 0.120 inch (3.05 mm) long by 0.040 inch (1.02 mm) wide fed with compressed air at 120 psig (827 kPa) and 25° C. It is located 15 inches (38.1 cm) from outlet 38. The winding tension between rolls 24 and windup 26 is 175 grams. Rolls 24 are driven at 500 ypm (457 mpm).

For Example 6 end 10 is 1245 denier Du Pont Type 497A deep acid dyeable nylon 66 yarn and ends 11 are 1225 denier Type 495 and 1245 denier Type 497A. Other conditions are the same as in Examples 1–5.

The yarn for Example 7 was prepared by feeding three ends of BCF yarn as shown in FIG. 4. The remainder of the process not shown in FIG. 4 is the same arrangement as shown in FIG. 1. Yarn 10 is 1225 denier Du Pont Type 494 cationic dyeable BCF and yarns 11 are 1225 denier Type 495 light acid dyeable and 1245 denier Type 497A deep acid dyeable BCF. Heating device 18 has an inlet 28, of a passage 30, having 0.100 inch (2.54 mm) diameter, 6 inches (15.24 mm) long, steam orifice 34 having 0.076 inch (1.93 mm) diameter, chamber 32 having 0.107 inch (2.72 mm) inside diameter, one inch (2.54 cm) long and outlet 38 with passage 36 having 0.110 (2.8 mm) inside diameter and 12 inches (30.5 cm) long. Torque jet 23 has yarn passage 40 having 0.125 inch (3.18 mm) diameter, one inch (2.54 cm) long with rectangular air orifice 32 0.145 inches (3.68 mm) long by 0.050 inches (1.27 mm) wide and is fed with compressed air at 120 psig (827 kPa) and 25° C. The yarn speed is 373 ypm (341 mpm). The larger apparatus dimensions are required to accomodate the larger diameter due to the wrapping method of the combined yarns.

TABLE IIA

| | Control | Ex. 1 | Ex. 2 | Ex. 3 |
|---|---|---|---|---|
| Denier-Yarn 10 | 1225 | 1225 | 1225 | 1225 |

TABLE IIA-continued

| | Control | Ex. 1 | Ex. 2 | Ex. 3 |
|---|---|---|---|---|
| Tension-Yarn 10, gms | 30 | 100 | 100 | 100 |
| Tension-Yarn 10, gpd | 0.024 | 0.080 | 0.080 | 0.080 |
| Denier-Yarns 11 | 1245 | 1245 | 1245 | 1245 |
| Tension-Yarns 11, gms | 30 | 30 | 10–20 | 10–20 |
| Tension-Yarns 11, gpd | 0.024 | 0.024 | 0.008–0.016 | 0.008–0.016 |
| Differential Tension Yarn 10 - Yarn 11, gpd | 0 | 0.056 | 0.064–0.072 | 0.064–0.072 |
| Sat. steam temp., °C. | 166 | 166 | 168 | 166 |
| Sat. steam press. psig. | 90 | 90 | 95 | 90 |
| Sat. steam press. kPa | 621 | 621 | 635 | 621 |
| Total yarn denier | 3850 | 3850 | 3820 | 3780 |
| Twist after boil-off, tpi | 2.5 | 2.25 | 3.25 | 3.75 |
| turns per cm. | 0.98 | 0.98 | 1.28 | 1.48 |
| Cylinder Bulk, cc/gm | | | | |
| Whole yarn bundle | 5.70 | | 5.00 | 5.15 |
| Yarn 10 | 6.10 | | 6.20 | 6.35 |
| 1st Yarn 11 | 5.90 | | 4.90 | 4.90 |
| Yarn 11/10, % | 97 | | 79 | 75 |
| 2nd Yarn 11 | 5.30 | | 4.85 | 4.95 |
| Yarn 11/10, % | 87 | | 78 | 76 |
| Filament Length | | | | |
| Yarn 10, in. | 2.02 | 2.01 | 2.02 | 2.02 |
| Yarn 10, cm. | 5.13 | 5.11 | 5.13 | 5.13 |
| Yarn 11, in. | 2.02 | 2.20 | 2.21 | 2.16 |
| Yarn 11, cm. | 5.13 | 5.59 | 5.61 | 5.49 |
| Difference, in. | 0 | 0.19 | 0.19 | 0.14 |
| cm. | 0 | 0.48 | 0.48 | 0.36 |
| % of Yarn 10 | 0 | 9.5% | 9.5% | 7.0% |

TABLE IIB

| | Ex. 4 | Ex. 5 | Ex. 6 | Ex. 7 |
|---|---|---|---|---|
| Denier-Yarn 10 | 1225 | 1225 | 1245 | 1225 |
| Tension-Yarn 10, gms | 100 | 100 | 100 | 100 |
| Tension-Yarn 10, gpd | 0.080 | 0.080 | 0.080 | 0.080 |
| Denier-Yarns 11 | 1245 | 1245 | 1225/1245 | 1225/1245 |
| Tension-Yarns 11, gms | 10–20 | 10–20 | 10–20 | 10–20 |
| Tension-Yarns 11, gpd | 0.008–0.016 | 0.008–0.016 | 0.008–0.016 | 0.008–0.016 |
| Differential Tension Yarn 10 - Yarn 11, gpd | 0.064–0.072 | 0.064–0.072 | 0.064–0.072 | 0.064–0.072 |
| Sat. steam temp., °C. | 164 | 162 | 164 | 174 |
| Sat. steam press. psig. | 85 | 79 | 85 | 111 |
| Sat. steam press. kPa | 586 | 545 | 586 | 765 |
| Total yarn denier | 3800 | 3770 | 3850 | 3970 |
| Twist after boil-off, tpi | 3.0 | 2.0 | | |
| turns per cm. | 1.18 | 0.79 | | |
| Cylinder Bulk, cc/gm | | | | |
| Whole yarn bundle | 5.35 | 5.85 | | |
| Yarn 10 | 6.60 | 7.10 | | |
| 1st Yarn 11 | 5.10 | 5.50 | | |
| Yarn 11/10, % | 77 | 78 | | |
| 2nd Yarn 11 | 5.10 | 5.75 | | |
| Yarn 11/10, % | 77 | 81 | | |
| Filament Length | | | | |
| Yarn 10, in. | 2.01 | 2.02 | | 2.00 |
| Yarn 10, cm. | 5.11 | 5.13 | | 5.08 |
| Yarn 11, in. | 2.21 | 2.12 | | 2.20 |
| Yarn 11, cm. | 5.61 | 5.38 | | 5.59 |
| Difference, in. | 0.20 | 0.10 | | 0.20 |
| cm. | 0.50 | 0.25 | | 0.51 |
| % of Yarn 10 | 10.0% | 5.0% | | 10.0% |

Examples 2–5 illustrate the effects of varying the temperature of the saturated steam from 168° C. to 162° C. At 160° C., the lower tension yarns are so poorly heat set into their wrapped configuration that they separate from the higher tension yarn occasionally and project from the surface of a wound package, causing tension plucks in yarn feeding off the package into a carpet tufting machine and possible jamming of the yarn in creel guide tubes or tufting needles. It has been found that latent torque can be set into yarns at temperatures too low to produce adequate heat setting of the wrapping yarn into its wrapped configuration.

At yarn speeds higher or lower than 500 ypm (457 mpm), the steam temperature will need to be raised or lowered to give adequate setting.

The unusual nature of yarns of the invention can also be shown by observing samples which have been dyed at the boil in skein form, allowed to dry, and then 1-meter length portions are suspended from an elevated clamp. They are observed first when hanging under their own weight and then when a 150 gm weight is attached to the lower end.

TABLE III

| | Unweighted | Weighted |
|---|---|---|
| Control | All components equally voluminous<br>Little twist evident<br>No yarn wraps around another | All components equally tensioned, but crimpy<br>No observed twist - components parallel<br>No yarn wraps around another |
| Example 3 | Core voluminous and straight<br>Wrapping yarns coil together around core nearly 360° C., direction reverses every 1–3 inches<br>Wrapping yarns have less bulk than core<br>No observed twist in whole bundle<br>Wrap ends in contact with core and each other | Core straightened, little bulk<br>Wrapping yarns coil about 180° C.<br>Wrapping yarns have more bulk than core<br>No observed twist in whole bundle<br>Wrap ends in contact with core and each other |
| Example 7 | Core hanging straight, voluminosity restrained by wraps<br>Wrapping yarns out of phase, cover about 80% of core<br>Wrapping yarns form irregular tubular sheath<br>No observed twist in bundle<br>Wrap ends in contact with core and each other other | Core straightened, little bulk<br>Wrapping yarns out of phase, cover about 80% of core<br>Wrapping yarns form irregular tubular sheath<br>No observed twist in in bundle<br>Wrap ends in contact with core and each other |

The Control, which was made with 30 gms tension on all component yarns, did not show any evidence of one yarn wrapping around another. All component yarns showed the same degree and direction of twist at any given location along the Control yarn length.

In both Examples 3 and 7, the core filaments could be pulled out of a 1 inch (2.54 cm) cut length, leaving the wrapping yarns in their reversing configuration. The wrapping yarns could then be separated from each other. The wrap yarns of Example 7 form a hollow tube when core filaments have been extracted. When the weights are removed from the yarns of Examples 3 and 7, the yarns return to their unweighted appearance without any substantial separation of wrapping yarns from the core, at least for a small number of tensioning cycles.

The above yarns from Examples 1–7 are tufted into level loop carpet of ⅛ inch (3.18 mm) gauge, ½ inch (1.27 cm) pile height, 45 oz. per square yard (1526 gms/m$^2$) 9 stitches per inch (3.54 stitches per cm) and are beck dyed with agitation. Carpets made from the yarns of Examples 1–6 are dyed light and dark shades of red-brown. The three component yarns of Example 7 are dyed light blue, dark blue and rust.

All carpets of this invention showed randomly twisted loops which have moved out of normal alignment in rows and present different distributions of color to the viewer. The carpet surfaces are uneven. Among Examples 1–6 the yarns made at the highest temperatures have the firmest hand, suitable for heavy traffic. The double-wrapped yarn of Example 7 set at high temperature is particularly resistant to crushing, yet has adequate bulk and cover.

EXAMPLE 8–11

These examples employ as one component of a yarn of this invention a previously entangled 3775 denier Type 359A nylon 66 heather yarn which has been prepared by tensioning one end each of 1225 denier Du Pont Type 494 cationic, 1225 Type 495 light acid and 1245 Type 497A deep acid dyeable yarns to remove substantially all of their cohesion then entangling them together in accordance with Nelson, U.S. Pat. No. 4,059,873.

The process is in accordance with that shown in FIG. 4. In Examples 8 and 9, the higher tension yarn 10 is 1225 Type 495 and the lower tension yarn 11 is 3775 Type 359A. In Example 10, the higher tension yarn 10 is 3775 Type 359A and the lower tension yarns 11 are two ends of 1225 Type 495. Example 11 is the reverse of Example 10 where yarns 10 are two ends of 1225 Type 495 and yarn 11 is 3775 Type 359A. The dimensions of heating device 18 and torque jet 23 are the same as in Example 7, but the air pressure of the torque jet is 150 psig (1034 kPa) in Examples 10 and 11. The yarn speeds are 500 ypm (457 mpm) is Examples 8 and 9 and 750 ypm (685 mpm) in Examples 10 and 11.

TABLE IV

| | Ex. 8 | Ex. 9 | Ex. 10 | Ex. 11 |
|---|---|---|---|---|
| Denier-Yarn 10 | 1225 | 1225 | 3775 | 1225(2) |
| Tension-Yarn 10, gms | 220 | 80 | 300 | 250 |
| Tension-Yarn 10, gpd | 0.180 | 0.065 | 0.079 | 0.102 |
| Denier-Yarn 11 | 3775 | 3775 | 1225(2) | 3775 |
| Tension-Yarn 11, gms | 35 | 35 | 20 | 60 |
| Tension-Yarn 11, gpd | 0.009 | 0.009 | 0.008 | 0.016 |
| Differential Tension Yarn 10 - Yarn 11, gpd | 0.171 | 0.056 | 0.071 | 0.086 |
| Sat. steam temp., °C. | 173 | 173 | 176 | 176 |
| Sat. steam press. psig | 107 | 107 | 117 | 117 |
| Sat. steam press. kPa | 738 | 738 | 807 | 807 |
| Total yarn denier | 4890 | 5050 | 6350 | 6350 |

The yarns of Examples 8 and 9 are tufted into level loop carpet of ⅛ inch (3.18 mm) gauge, ½ inch (1.27 cm) pile height, 40 oz. per square yard (1356 gm/m$^2$) and 7 stitches per inch (2.76 stitches per cm) and are beck dyed with agitation as with Example 7. Yarns of Examples 10 and 11 are tufted 5/32 inch (3.97 mm) gauge, ½ inch (1.27 cm) pile height, 45 oz. per square yarn (1356 gms/m$^2$) 8 stitches per inch (3.15 stitches per cm) and dyed as with Examples 7–9. Examples 10 and 11 show the styling versatility of the present process. The carpet of Example 10 is predominantly light blue with flecks of dark blue and rust. By reversing the oomponent yarns the carpet of Example 11 is predominantly dark blue with flecks of light blue and rust.

EXAMPLE 12

This example demonstrates that some of the filaments are lightly bonded together. The yarn of Examples 2–5 were closely examined as described below.

To avoid disturbing the yarns' structures, yarns are embedded in an epoxy matrix before cross-sectioning. To do this, the specimen yarn is placed in a mold. Epoxy is poured around it and cured. The cured specimen block is removed from the mold, shaped and sectioned in a microtome. Cross-sections, mounted on a microscope slide, are photographed at suitable magnification.

The coated mold is sprayed lightly with release agent, and each cavity is lined with cellophane tape. Small "pillows" of double-faced masking tape (approximately 6 folds) are placed at the ends of each cavity.

Before placing the yarn in the molds, the yarn is prepared as follows. Approximately 200 mm of yarn are taped at both ends using small pieces of masking tape, clamps are attached to both ends, and the yarn is hung on a rack hook. Sufficient weight is added to the lower clamp to pull out any crimp, being careful not to stretch the yarn. Using an eyedropper, clear acrylic lacquer is applied a few drops at a time down the yarn. Approximately 10 applications about 3 minutes apart are made, then the sample is allowed to dry about 2 hours.

The coated specimen is placed in the mold cavity on the "pillows" of tape such that it lies below the mold surface but does not touch the bottom. The excess yarn is then cut off.

Epoxy resin to fill 8 mold cavities is prepared by mixing the following:

| | |
|---|---|
| Marglas Resin 658 crystal-clear epoxy casting resin (manufactured by Acme Chemicals & Insulation Co.) | 21.7 g |
| Marglas Resin 659 crystal-clear epoxy casting resin (manufactured by Acme Chemicals & Insulation Co.) | 4.4 g |
| Maraset modified diamine curing agent Hardener 558 (manufacture by Acme Chemicals & Insulation Co.) | 25.0 g |

The resin mixture is stirred slowly for about 5 minutes to prevent bubble formation. Stirring should continue until the solution is clear.

The epoxy solution is then poured over each specimen. Bubbles can be eliminated by manipulation of the specimen with a pair of forceps. If the sample sinks to the bottom or floats to the top of the mold, the yarn must be repositioned. The resin can be cured at room temperature for 16 hours (or at 65° C. for 3 hours).

After curing, the room temperature cured mold is placed on a warming table for about 15 minutes. By grasping the ends of the cellophane tape, the warm specimen block can be removed from the mold. (Oven-cured specimens are removed from the mold immediately after removal from the oven.) The specimen block is cooled on a flat surface and then the cellophane tape is removed.

Each specimen block is shaped and then placed on a warming table for about 2 minutes to relax filaments. The specimen block is then mounted in a Microtome (Rotary Model 820—American Optical) and 7-micron thick cuts are made. The first few cuts are discarded. A good cut (one with no obvious air bubbles or knife blade marks or tilt to the filaments) is laid on a microscope slide thinly coated with Primol 335 (n=1.5) or mineral oil (n=1.47). Once the cut has been inspected under the microscope and determined to be satisfactory, a cover glass is placed over the specimen. Photographs are taken at appropriate magnification.

Figure 11:
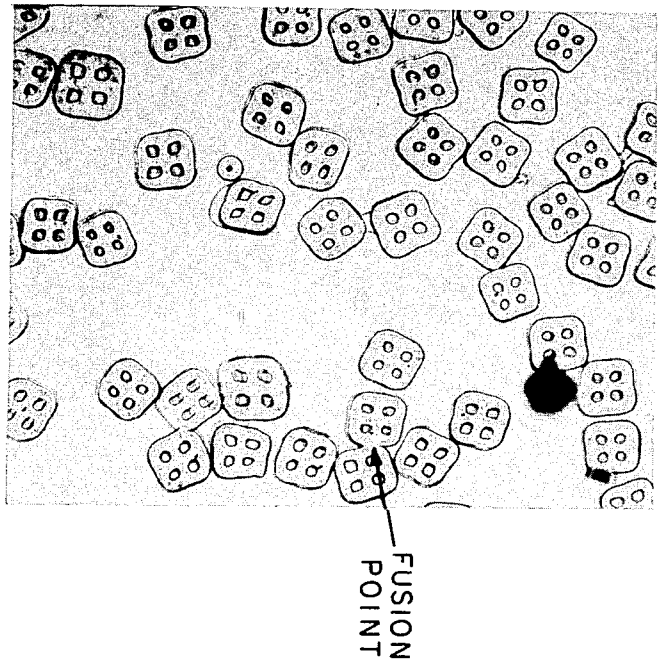
FIG. 11 is a photograph of a cross-section of Example 3.

Cross-sectional photographs of the yarns indicate increasing fusion points with increasing steam temperature and the loss of fusion points after carpet processing. Fusion is determined by examining the cross-sectional photograph for loss of boundary definition between two touching filaments. This is shown in FIG. 11 which is a cross-sectional photograph of the yarn of Example 3.

In Examples 13–16, 1250 denier blue polypropylene multi-filament yarn 10 at 100 gms tension is combined with two ends of 750 denier uncolored polypropylene at 20 gms tension. The filaments have a rounded square cross section with four continuous voids. Heating device 18 has an inlet 28 of passage 30 having 0.070 inch (1.78 mm) inside diameter 8 inches (20.3 cm) long, steam orifice 34 of 0.074 inches (1.88 mm) diameter, chamber 32 having 0.104 inch (2.64 mm) inside diameter 1 inch (2.54 cm) long and outlet 38 with passage 36 having 0.070 inch (1.78 mm) inside diameter 12 inches (30.5 cm) long. Torque jet 23 is as in Example 7 fed with compressed air at 80 psig (551 kPa) and 25° C. The yarn speed is 500 yard/min. (457 m/min.). Other data are in Table V.

The core filaments of Example 13 are lightly bonded but separate easily. The wrapping filaments separate with difficulty. Examples 14–16 are increasingly cohesive at increasing steam temperatures. Example 17 is so fused that it is unacceptably harsh for carpet use.

TABLE V

| | Ex. 13 | Ex. 14 | Ex. 15 | Ex. 16 | Ex. 17 |
|---|---|---|---|---|---|
| Denier-Yarn 10 | 1250 | 1250 | 1250 | 1250 | 1250 |
| Tension-Yarn 10, gms | 100 | 100 | 100 | 100 | 100 |
| Tension-Yarn 10, gpd | 0.08 | 0.08 | 0.08 | 0.08 | 0.08 |
| Denier-Yarns 11 | 2 × 750 | 2 × 750 | 2 × 750 | 2 × 750 | 2 × 750 |
| Tension-Yarns 11, gms | 20 | 20 | 20 | 20 | 20 |
| Tension-Yarns 11, gpd | 0.027 | 0.027 | 0.027 | 0.027 | 0.027 |
| Differential Tension Yarn 10-Yarn 11, gpd | 0.053 | 0.053 | 0.053 | 0.053 | 0.053 |
| Sat. steam temp., °C. | 156 | 158 | 160 | 162 | 164 |
| Sat. steam press. psig. | 66 | 70 | 75 | 79 | 84 |
| Sat. steam press. kPa | 454 | 482 | 517 | 544 | 579 |
| Total yarn denier | 2500 | 2500 | 2500 | 2500 | 2500 |
| Twist after | | | | | |
| boil-off, tpi | 1.5 | 2.0 | 1.6 | 1.6 | 0.6 |
| turns per cm. | 0.59 | 0.79 | 0.63 | 0.63 | 0.24 |
| Cylinder Bulk, cc/gm | | | | | |
| Whole Yarn bundle | | | | | |
| Yarn 10 | 9.25 | 8.75 | 8.75 | 8.6 | 8.4 |
| Yarn 11 | 7.15 | 6.65 | 7.65 | 8.75 | 7.25 |
| Yarn 11/10, % | 92 | 84 | 81 | 76 | 63 |
| Filament Length | | | | | |
| Yarn 10, in. | 1.94 | 2.00* | 2.00* | ** | ** |
| Yarn 10, cm. | 4.93 | 5.08 | 5.08 | | |
| Yarn 11, in. | 2.13 | 2.06 | 2.10 | ** | ** |
| Yarn 11, cm. | 5.41 | 5.23 | 5.33 | | |
| Difference, in. cm. | | | | | |
| % of Yarn 10 | 9.8 | 3.0 | 5.0 | | |

*Length total Yarn 10 - Fils too fused to separate for reliable length measurement
**Yarns 10 and 11 fused together The core filaments of Example 13 are lightly bonded but separate easily. The wrapping filaments separate with difficulty. Examples 14–16 are increasingly cohesive at increasing steam temperatures. Example 17 is so fused that it is unacceptably harsh for residential carpet use but may be suitable for industrial use.

Cut pile carpets are tufted ⅛ inch (3.2 mm) gauge and sheared to 7/16 inch (11.2 mm) pile height at 40 oz. pile yarn per square yard (1350 gms/sq. meter) 9 stitches per inch (3.54 per cm) from the yarn of Examples 13–17. The carpet of Example 13 has a soft, cotton-like feel but may be subject to poor matting characteristics. The carpet of Example 17 approaches the stiffness of artificial grass. Carpets of Examples 14–16 are intermediate.

The preferred polymers for yarns of the invention are polyamides and polypropylene because of their general suitability for carpet use and their ability to retain crimp and bulk at temperatures needed to set twist and bond filaments. Copolymers of polyamides or polypropylene having appropriate twist setting or filament bonding behavior at given yarn speed and steam treatment conditions may be selected for either the core or wrapping components to obtain a particular product. Similarly, a polypropylene core yarn may be used with a polyamide wrapping yarn, the higher-melting polyamide being exposed more directly to the steam while the twisted, compacted polypropylene having a lower melting point is treated mainly on its outer surface.

I claim:

1. A continuous multifilament crimped polyamide yarn suitable for use in loop pile carpeting comprising at least one continuous multifilament crimped core yarn and at least one continuous multifilament crimped wrap yarn characterized by:

(a) the filaments of the wrap yarn being from 1 to 14% longer than the filaments of the core yarn;
(b) some of the filaments within the wrap yarn being lightly bonded to each other and to some of the filaments of the core yarn;
(c) the wrap yarn being wrapped around the core yarn in random reversing coils; and
(d) the wrap yarn being tightly wrapped around the core yarn.

2. A continuous multifilament crimped polypropylene yarn suitable for use in loop pile carpeting comprising at least one continuous multifilament crimped core yarn and at least one continuous multifilament crimped wrap yarn characterized by:

(a) the filaments of the wrap yarn being from 1 to 14% longer than the filaments of the core yarn;
(b) some of the filaments within the wrap yarn being lightly bonded to each other and to some of the filaments of the core yarn;
(c) the wrap yarn being wrapped around the core yarn in random reversing coils; and
(d) the wrap yarn being tightly wrapped around the core yarn.

3. The yarn of claim 2 further characterized by the wrap yarn having cylinder bulk of about 70–90% of the core yarn.

4. The yarn of claim 1 or 2 further characterized by a twist after boil-off of at least one twist per inch (39 twists per meter).

5. The yarn of claim 4 wherein the yarn has essentially no true twist.

6. The yarn of claim 1 wherein the yarn has a twist after boil-off of at least two twists per inch (79 twists per meter).

7. The yarn of claims 1 or 2 further comprising less than 10% of uncrimped filaments.

8. The yarn of claim 7 wherein the uncrimped filaments are antistatic.

9. The yarn of claim 1 further characterized by the wrap yarn having cylinder bulk of about 70–85% of the core yarn.

10. The yarn of claim 1 wherein the crimped core yarn is polypropylene.

* * * * *